United States Patent [19]

Suniewski

[11] Patent Number: 5,071,068

[45] Date of Patent: Dec. 10, 1991

[54] ATOMIZER

[75] Inventor: Stanislaw E. Suniewski, Mobberley, United Kingdom

[73] Assignee: Hirt Combustion Engineers Ltd., Mobberley, United Kingdom

[21] Appl. No.: 399,514

[22] Filed: Aug. 25, 1989

[30] Foreign Application Priority Data

Feb. 28, 1987 [GB] United Kingdom ..... 8704749

[51] Int. Cl.[5] ..... B05B 7/10; B01F 5/00; F23D 11/38

[52] U.S. Cl. ..... 239/8; 239/403; 239/430

[58] Field of Search ..... 239/8, 403, 405, 406, 239/430

[56] References Cited

U.S. PATENT DOCUMENTS 1,535,575 4/1925 Chisholm et al. ..... 239/403 X
3,088,681 5/1963 McCutcheon ..... 239/405
3,601,318 8/1971 Tamins et al. ..... 239/430 X
3,615,053 10/1971 Pease et al. ..... 239/430 X

FOREIGN PATENT DOCUMENTS 2143443 2/1985 United Kingdom .

*Primary Examiner*—Andres Kashnikow
*Assistant Examiner*—William Grant
*Attorney, Agent, or Firm*—Salter & Michaelson

[57] ABSTRACT

An atomizer for use in the combustion of liquids, particularly liquids containing particulate materials, comprises a body having a duct therein for the liquid to be atomized and a plurality of flow passages therein for a supply of atomizing gas such as air or natural gas, the flow passages intersecting with the duct at such positions and at such angles that the atomizing gas has a significant proportion thereof directed along paths tangential to the duct.

9 Claims, 1 Drawing Sheet

ATOMIZER

This invention relates to an atomiser which can be used to introduce a gas, usually air into a liquid, such as oil, to form a fine "atomised" spray. This will normally be a combustible mixture of oil and water which is ignited. However, the atomiser can be used in other environments wherein a liquid has to be atomised.

A known atomiser includes a body having within it a first plurality of flow paths for the liquid to be atomised all leading to ports at a surface of the body, and a second plurality of flow paths for atomising gas intersecting the first plurality of flow paths. Where each of the first plurality of flow paths is intersected by a gas path there is usually a sharp difference in direction between the two paths which are usually of comparable cross-sectional size.

Such a known atomiser has several disadvantages. Firstly, the angled intersection of the two flow paths results in a deal of turbulence and frictional energy loss, which means that relatively high pressures have to be used to achieve atomisation of a liquid of a given viscosity. Secondly, the fluid flow passages tend to be rather small in cross-sectional area and this makes them unsuitable for use with liquids containing entrained solids, such as slurries and waste oil.

It is an object of the present invention to provide an improved atomiser.

The invention provides an atomister comprising a body having a duct for a liquid to be atomised and a plurality of flow passages for an atomising gas, the flow passages being directed to intersect the duct at such positions and at such angles that the atomising gas flowing into the duct has a significant proportion thereof directed along paths tangential to the duct characterised in that the duct for the liquid to be atomised is straight and unobstructed. A preferred atomiser of the invention can have one or more of the following optional features:

The duct has the form of a venturi, comprising a convergent section, a constricted section and a divergent section, some or all of the passages intersecting the duct in the constricted section. The convergent section may be omitted on small fluid throughputs.

The divergent section is preferably constructed to constitute a diffuser. The convergent section is desirably constructed to be an inverse diffuser. That is to say its angle is chosen to be such as to cause an increase in fluid velocity without turbulence. The divergent section is frusto conical with a cone angle from 20° to 30°, preferably 25°. The cross sectional area of each flow passage is $\leqq 33.3\%$, preferably $\leqq 25\%$ of the cross sectional area of the duct. The duct is normally circular in cross section and each passage is also circular in cross section, the diameter of each passage being equal to or less than one half of the diameter of the duct.

Each passageway has a wall portion which meets a wall portion of the duct tangentially or as close to tangentially as is mechanically convenient.

The gas passages are arranged in groups spaced along the duct. There are two, three or more such groups. Each group can contain a number of passages arranged generally in a common plane disposed radially relative to the duct axis. The number of passages in each group can be two or more and those in the group can be radially spaced around the axis, preferably equally radially-spaced. When the number of passages in each group is the same, the set of passages of each group is preferably radially offset relative to the passages in the adjacent group or groups.

The gas passages are arranged each to direction a stream of gas into the liquid duct in a direction transverse to an axis of the duct and tangential to side walling of the duct.

The duct can be annular in cross section or may be circular, polygonal, elliptical or curved. In cases on non circularity "tangential" is to be interpreted as meaning with a substantial portion at grazing incidence to a wall part of the liquid duct.

The invention will be described further, by way of example, with reference to the accompanying drawings, wherein.

Figure 1:
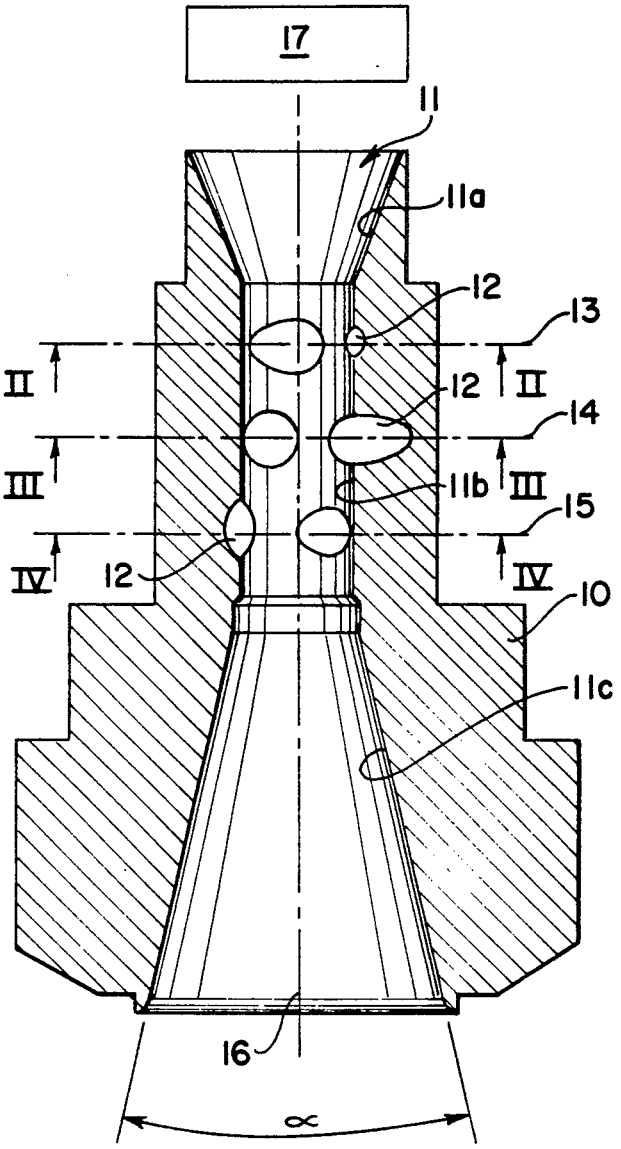
FIG. 1 is a longitudinal cross section through a preferred atomiser of the invention.

A preferred atomiser of the invention includes a body 10 wherein is a duct 11 for liquid, particularly viscous, solids-contaminated waste oil, to be atomised for combustion. As is clear from the drawing the duct 11 is straight and unobstructed and provides a straight flow path for the liquid to be atomised. A plurality of flow passage 12 intersect with duct 11 and are connected to a source of compressed gas, such as air. Flow of liquid through the duct 11 is from top to bottom in the drawing, and (considered in this direction) the duct 11 has, sequentially, a converging section 11*a*, a constricted section 11*b* and a divergent diffusing section 11*c*. An annular manifold (not shown) can surround the body 10 adjacent section 11*b* to supply gas to passages 12. A liquid supply means 16 is provided for supplying a viscous fluid containing particulates to the upstream end of the duct 11 as illustrated.

Section 11*c* is a diffuser to convert dynamic pressure in the flow to static pressure and the angle of the frustoconical section 11*c* ($\alpha$) can be from 20° to 30°, preferably 25°.

Figure 2:
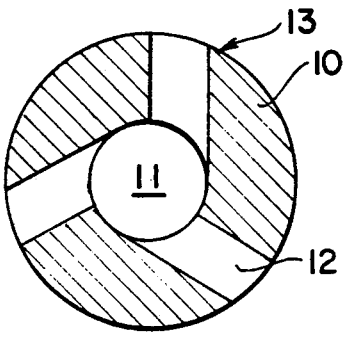
FIG. 2 is a cross section on line II—II of FIG. 1.
Figure 3:
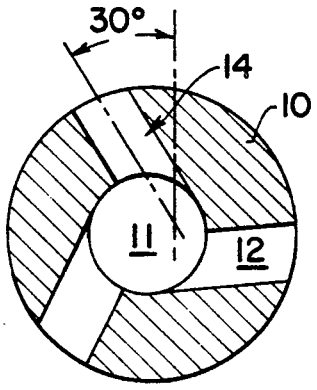
FIG. 3 is a cross section on line III—III of FIG. 1.
Figure 4:
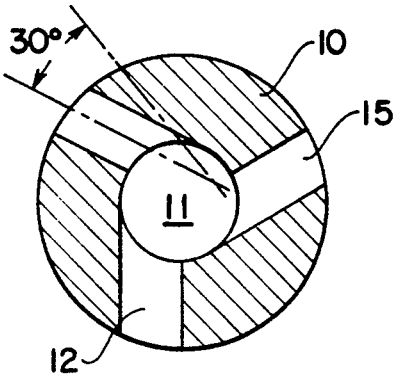
FIG. 4 is a cross section on line IV—IV of FIG. 1.

As best seen in FIGS. 2, 3 and 4 the passages 12 are arranged in three groups 13,14,15 spaced along the axis 16 of duct 11. The passages in each group are circular in cross section and lie in a plane disposed at right angles to axis 16. The passages 12 in each group are spaced equidistantly about the axis 16 and the respective groups 13,14,15 are radially mutually spaced at 30° intervals as will be seen in FIGS. 2 to 4. The angle can be from 20° up to 40°.

The atomiser of the invention is a considerable improvement over know atomisers and its liquid flow passage 11 is of significant size, for example from 5 to 10 mm in diameter. Very viscous liquids, liquids contaminated with solids and waste oil so thick and/or contaminated with solids that normal atomisers cannot cope can, surprisingly, be burnt using the atomiser aforesaid in accordance with the invention. When used with thinner liquids, atomisation can be achieved at lower pressures of liquid and gas than have been previously necessary. This results in savings in pump power and installation strengths. The atomiser of the invention is suitable for burning coal/water slurries.

The use of the tangential impingement of the gas jets to the peripheral walls of the duct is beneficial in destroying the laminar surface flow layer which tends to develop on the surface of the duct, and convert it to a turbulent gasified mixture, further, improved atomisation is achieved because a considerable part of the energy dissipated by the expanding atomising gas appears as rotational velocity in the fluid stream. Liquid in the diffuser section 11c has a rotational velocity component in addition to the longitudinal velocity generated by the expanding gas/liquid mix. Since it is shear stresses generated by liquid velocity which breaks up the liquid into fine droplets, the rotation component materially assists atomisation compared with what could be achieved by longitudinal velocity alone.

The flexibility in number and size of gas ports relative to the liquid passages permitted by the basic shape of the nozzle enables a wider range of atomising gas to fluid flow ratios than a conventional atomiser can achieve. This is of value in achieving improved burning of difficult products, particularly in reducing the formation of unburnt carbon particles and smut in the stack gases.

The invention is not limited to the precise details of the foregoing and variations can be made thereto. For example, the dimensions of and the cross-sectional shapes of the duct and of the passages can vary widely. The passageways can lie in a plane or planes which have angles to the axis 16 different from 90°. There can be any convenient number of groups of passageways 12.

The atomising gas can, in certain circumstances, be a fuel gas, such as natural gas, for use in circumstances where a user has insufficient waste oil to burn to meet heating needs. The atomised liquid can be a coal/water slurry. The atomiser of the invention creates a flame which, because of the swirl, is of short axial length compared with conventional flames. This firstly reduces the length of combustion chamber required, but, more importantly, exposes wide area of flame to impingement by secondary air, giving rise to a high flame temperature with consequent efficient main combustion close to the nozzle, with the remainder of the combustion chamber being free for "polishing", i.e. oxidation of a small fraction of remaining products. The increased efficiency of atomisation also contributes to the short axial flame length. The time for a liquid product to burn is dependent upon droplet size because liquid droplets burn only on their surfaces. The atomiser of the invention produces smaller droplets which therefore burn faster contributing to a hotter, shorter flame. This has enabled poly chlorinated biphenyls (PCBs) to be incinerated without the production of dioxin.

The atomiser of the invention is also very tolerant of variations in its operating parameters. Probably because of the aspirating effect of the venturi, the air pressure can be reduced from (in a typical installation) its nominal value of 4.6 Bar down to 3.6 Bar without significant deterioration in its performance.

I claim:

1. An atomiser comprising a body having an upstream end and a downstream end and means for delivering a viscous fluid containing particulates to the upstream end of said body, said body having a duct formed therein for receiving said fluid for atomizing the latter, said duct extending in a straight line from said upstream end to said downstream end, said body also having a plurality of flow passages formed therein for supplying an atomising gas to said duct, said flow passages being positioned and directed such that a significant portion of the atomising gas entering said duct through said flow passages is directed along paths which are tangential to said duct, said duct comprising means for atomising the viscous fluid containing particulates including three sequentially disposed sections, namely:

a convergent section comprising an inverse diffuser which gradually tapers to increase fluid flow velocity without turbulence;

a constricted section; and a divergent section formed as a diffuser and extending from said constricted section to said downstream end;

all of said flow passages being located entirely within said constricted section; and each of said flow passages having an axis which lies at right angles to said straight line in which said duct extends.

2. An atomiser as claimed in claim 1 characterised in that the duct is circular in cross section and each passage is also circular in cross section, the diameter of each passage being equal to or less than one half the diameter of the constricted section of the duct.

3. An atomiser as claimed in claim 1, characterised in that the divergent section is frusto conical with a cone angle from 20° to 30°.

4. An atomiser as claimed in claim 3 characterised in that the angle is 25°.

5. An atomiser as claimed in claim 1 characterised in that the cross sectional area of each flow passage is ≦33.3% of the cross-sectional area of the constricted section of the duct.

6. An atomiser as claimed in claim 5 characterised in that the cross-sectional area of each flow passage is ≦ 25% of the cross-sectional area of the constricted section of the duct.

7. A method of burning a viscous solid-containing fluid fuel comprising passing it through the fluid duct of an atomiser as claimed in claim 1 to be atomised by gas entering via said passages and thence to a flame.

8. An atomiser comprising a body having an upstream end and a downstream end, and means for delivering a viscous fluid containing particulates to the upstream end of said body, said body having a duct formed therein for receiving said fluid for atomizing the latter, said duct extending in a straight line from said upstream end to said downstream end, said body also having a plurality of flow passages formed therein for supplying an atomizing gas to said duct, said flow passages being positioned and directed such that a significant portion of the atomising gas entering said duct through said flow passages is directed along paths which are tangential to said duct, said duct comprising means for burning the fluid containing particulates including three sequentially disposed sections; namely:

a convergent section comprising an inverse diffuser which gradually tapers to increase fluid flow velocity without turbulence;

a constricted section; and a divergent section formed as a diffuser and extending from said constricted section to said downstream end;

all of said flow passages being located entirely within said constricted section;

each of said flow passages having an axis which lies at right angles to said straight line in which said duct extends; and said flow passages being arranged in at least two groups; the flow passages in each group having respective axes, which axes are arranged in a common plane lying at right angles to said straight line in which said duct extends.

9. In the atomiser of claim 8, the flow passages in one group being circumferentially offset relative to the flow passages in the other group.

* * * * *